US006713952B1

(12) United States Patent
Lee

(10) Patent No.: US 6,713,952 B1
(45) Date of Patent: Mar. 30, 2004

(54) CATHODE RAY TUBE

(75) Inventor: Bong-Woo Lee, Suwon-si (KR)

(73) Assignee: Samsung Display Devices Co., Ltd., Suwon-si (KR)

( * ) Notice: Subject to any disclaimer, the term of this patent is extended or adjusted under 35 U.S.C. 154(b) by 0 days.

(21) Appl. No.: 09/363,121

(22) Filed: Jul. 28, 1999

(30) Foreign Application Priority Data

Nov. 24, 1998 (KR) ..... 98-50402

(51) Int. Cl.[7] ..... H01J 33/00
(52) U.S. Cl. ..... 313/479; 313/477 R; 313/477 HC
(58) Field of Search ..... 313/479, 477 R, 313/112, 477 HC, 364, 409–416, 421–22, 441, 446, 450, 461, 466, 473; 315/169.1, 169.3; 427/122, 64, 68, 287, 591; 445/23–24, 33–34, 44–45, 58

(56) References Cited

U.S. PATENT DOCUMENTS 3,806,750 A * 4/1974 Tsuneta et al. ..... 313/364
5,366,758 A * 11/1994 Jang ..... 427/64
5,751,102 A * 5/1998 Tanaka et al. ..... 313/479 X
5,962,964 A * 10/1999 Sano et al. ..... 313/477 R X
5,998,920 A * 12/1999 Kim ..... 313/479
6,087,767 A * 7/2000 Sano et al. ..... 313/477 R X
6,198,212 B1 * 3/2001 Kim et al. ..... 313/479 X

* cited by examiner

*Primary Examiner*—Ashok Patel
*Assistant Examiner*—Joseph Williams
(74) *Attorney, Agent, or Firm*—Christie, Parker & Hale, LLP

(57) ABSTRACT

A cathode ray tube includes a panel on which a phosphor screen is formed, a cylindrical neck in which an electron gun assembly is arranged, and a funnel formed between the panel and the neck. The funnel has a substantially rectangular cone portion on which a deflection yoke is mounted. An anode button is provided on the funnel to supply a high voltage in the funnel, and an inner graphite layer is disposed on an inner surface of the funnel to form a path for the transmission of the high voltage. The inner graphite layer satisfies at least one of the following conditions on an inner surface of the cone portion:

$$0.9 \leq Td/Th \leq 1.36$$

$$0.9 \leq Td/Tv \leq 1.36$$

where Td is a thickness of the inner graphite layer disposed on inside corners of the cone portion, Th is a thickness of the inner graphite layer disposed on inside horizontal walls of the cone portion, and Tv is a thickness of the inner graphtie layer disposed on inside vertical walls of the cone portion.

2 Claims, 3 Drawing Sheets

CATHODE RAY TUBE

CROSS REFERENCE TO RELATED APPLICATION

This application is based on application No. 98-50402 filed in the Korean Industrial Property Office on Nov. 24, 1998, the content of which is incorporate herein by reference.

BACKGROUND OF THE INVENTION (a) Field of the Invention

The present invention relates to a cathode ray tube, and more particularly, to a cathode ray tube having a substantially rectangular cone portion in which an inner graphite layer can be formed to an optimum thickness on the rectangular cone portion such that high voltages are more uniformly transmitted therethrough.

(b) Description of the Related Art

A cathode ray tube(CRT) is a device for displaying images on a screen by emitting electron beams from an electron gun assembly and landing the electron beams onto a phosphor screen. Conventional CRTs include a vacuum envelop having a panel on which the phosphor screen is formed, a neck in which the electron gun assembly is arranged, and a funnel formed between the panel and the neck.

Immediately after the electron beams are emitted, they are horizontally and vertically deflected by magnetic fields generated by a deflection yoke. Thus, the electron beams strike all pixels on the phosphor screen. The deflection yoke is mounted on the exterior of the funnel, i.e., on a cone portion of the funnel. The cone portion is formed contiguous to the neck. A cross section of the cone portion typically reveals a circular form, and a cross section of the deflection yoke reveals an inner circumference that is circular.

In such a CRT, the deflection efficiency of the deflection yoke is low since there is a considerable amount of space between deflection coils of the deflection yoke and the electron beams. To improve the deflection efficiency, power applied to the deflection yoke is increased. However, this increases the overall power consumption of the CRT and induces leakage of the magnetic fields.

To solve these problems, a cone portion having a cross section that gradually changes from a circular form of the neck to a rectangular form of the panel has been developed. Because a shape at which the electron beams passing inside the cone portion is distributed substantially rectangular to correspond to the rectangular image produced on the panel, the cone portion is made into as close a shape to match the rectangular distribution shape of the electron beams as possible. Accordingly, an inner circumference of the deflection yoke mounted on the cone portion is also rectangular in shape.

Such a rectangular cone portion has various advantages. First, the electron beams can be prevented from striking the inner surface of the funnel since the rectangular shape provides space in the four diagonal portions on which the electron beams are likely to strike. Second, the deflection efficiency can be increased by enabling the electron beams to come close to the deflection coils in the horizontal and vertical portions of the cone portion. Third, power consumption of the deflection yoke and magnetic field leakage generated by the deflection yoke can be reduced.

However, the rectangular cone portion is not rotationally symmetical, and the four comers thereof are formed having curvatures rather than the horizontal and vertical portions. As a result, when the inner graphite layer is applied on the inner surface of the funnel, it is not as uniformly applied on inside comers as it is on inside horizontal and vertical walls of the cone portion.

The inner graphite layer is a conductive layer which is disposed on the inner surface of the funnel at a predetermined thickness, and acts to transmit a voltage applied through an anode button to an accelerating electrode of the electron gun assembly and the panel. Thus, the electron beams are focused by a difference in potential between the voltages applied to the accelerating electrode and a focusing electrode of the electron gun, after which the electron beams are accelerated onto the phosphor screen by the high voltage on the panel.

Hence, it is important that the inner graphite layer uniformly transmits the high voltage so that the electron beams are exactly focused and accelerated. Accordingly, the inner graphite layer must have a constant resistance. Since the resistance of the inner graphite layer is directly related to its thickness (i.e., greater thickness results in smaller resistance), it is essential that the inner graphite layer be evenly applied on the inner surface of the funnel.

However, because of the shape of the rectangular cone portion, the inner graphite layer can not be as evenly applied on the inside comers as on the inside horizontal and vertical walls of the cone portions. Consequently, a constant resistance over the entire inner graphite layer is not realized, thereby reducing the overall performance of the CRT.

SUMMARY OF THE INVENTION

It is an object of the present invention to provide a cathode ray tube having a rectangular cone portion in which an inner graphite layer is formed to an optimum thickness.

It is another object of the present invention to provide a cathode ray tube capable of uniformly transmitting a high voltage to an accelerating electrode of a electron gun assembly and a panel.

In order to achieve these objects, the CRT includes a rectangular panel, a cylindrical neck, a funnel between the panel and the neck having a rectangular cone portion contiguous to the neck, an anode button to supply a high voltage in the funnel, and an inner graphite layer disposed on an inner surface of the funnel to form a path for the transmission of the high voltage. The inner graphite layer satisfies at least one of the following conditions:

$$0.9 \leqq Td/Th \leqq 1.36$$

$$0.9 \leqq Td/Tv \leqq 1.36$$

where Td is an approximate thickness of the inner graphite layer disposed on each side corner of the cone portion, Th is an approximate thickness of the inner graphite layer disposed on inside horizontal walls of the cone portion, and Tv is a thickness of the inner graphite layer disposed on inside vertical walls of the cone portion.

When the inner graphite layer satisfies the above conditions, it can uniformly transmit the high voltage to the accelerating electrode of the electron gun assembly and the panel.

The objectives and other advantages of the invention will be realized and attained by the structure particularly pointed out in the written description and claims as well as the appended drawings. It is also to be understood that both the foregoing general description and the following detailed description are not intended to limit the scope of this invention, many variations of which will be apparent to those with ordinary skill in the art. The disclosure of the specific embodiments are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate a particular embodiment of the invention and, together with the description, serve to explain the principles of the invention.

DETAILED DESCRIPTION OF THE PREFERRED EMBODIMENT

Reference will now be made in detail to a preferred embodiment of the present invention, an example of which is illustrated in the accompanying drawings.

Figure 1:
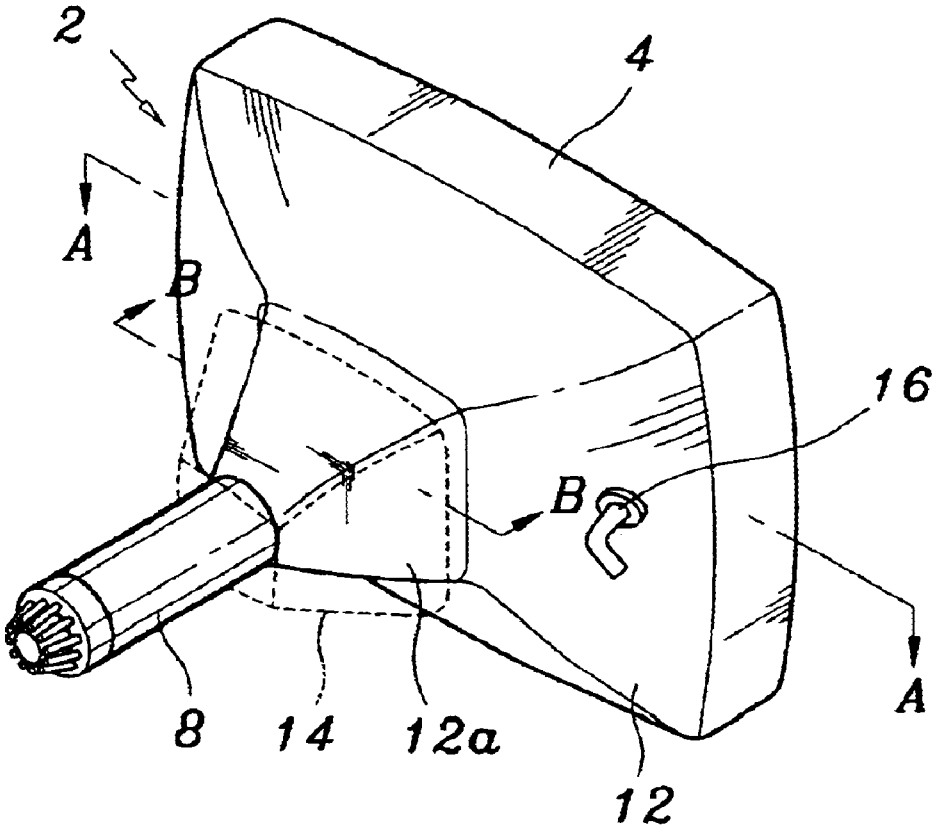
FIG. 1 is a perspective view of a cathode ray tube according to a preferred embodiment of the present invention.
Figure 2:
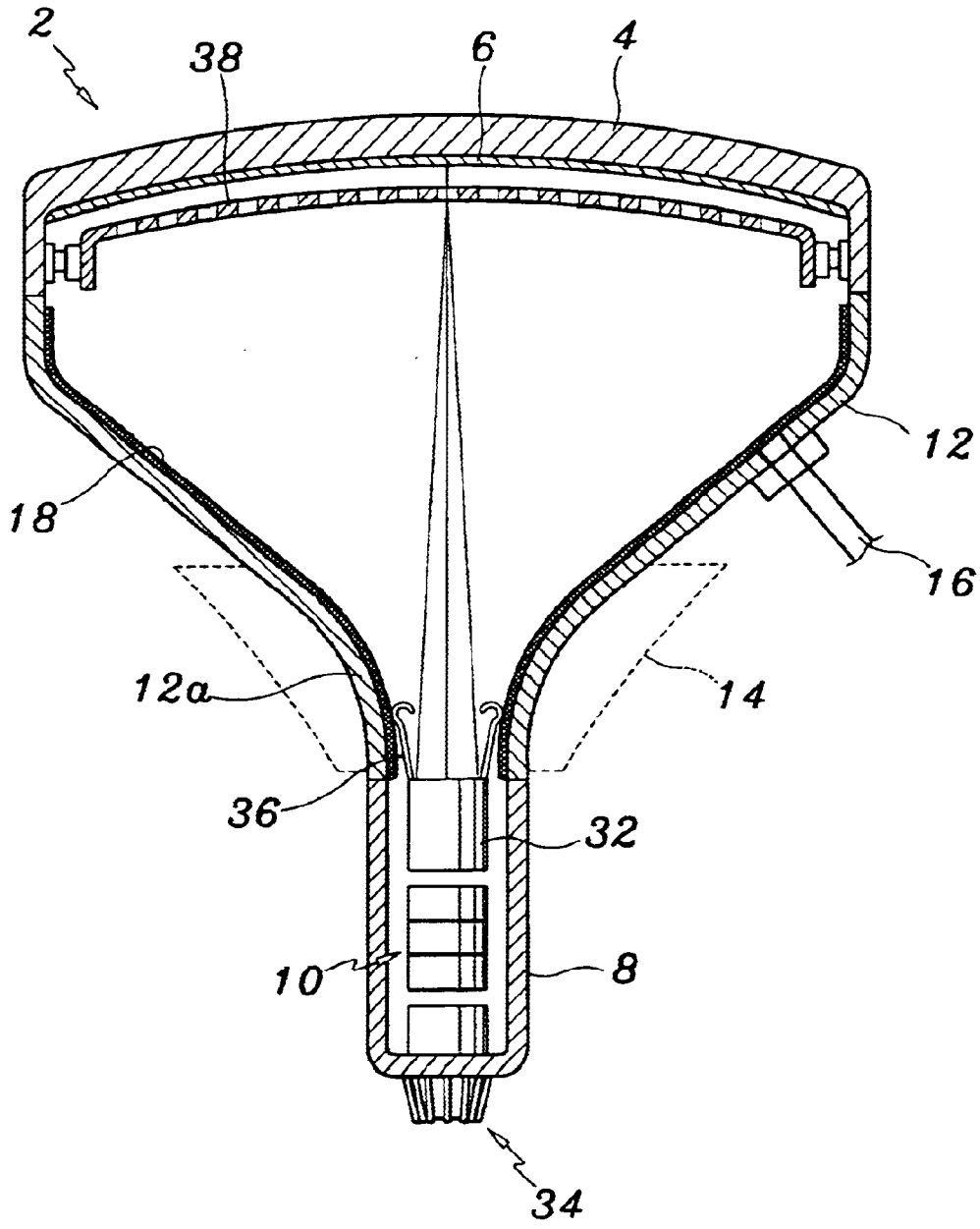
FIG. 2 is a sectional view taken along line II—II of FIG. 1.

As shown in FIGS. 1 and 2, a cathode ray tube according to a preferred embodiment of the present invention includes a vacuum envelop 2 which is formed with a substantially rectangular panel 4, a phosphor screen 6 being on an inside surface of the rectangular panel 4; a small cylindrical neck 8 in which an electron gun assembly 10 is arranged; and a funnel 12 formed between the panel 4 and the neck 8. The funnel 12 includes a cone portion 12*a* formed adjacent to the neck 8 and extending a predetermined distance in a direction toward the panel 4.

The phosphor screen 6 includes three phosphor layers, respectively, comprising red, green, and blue phosphors, the phosphors being formed in predetermined dot or stripe shaped patterns. The phosphor layers are excited and emit light by the striking of electron beams thereon. The electron beams are generated by the electron gun assembly 10.

The cross-sectional shape of the funnel 12 progressively changes from a circular form of the neck 8 to a rectangular form of the panel 4. In particular, the cone portion 12*a*, on which a deflection yoke 14 is mounted, is designed to have a substantially rectangular section. Thus, the deflection yoke 14 is preferably designed having a substantially rectangular section corresponding to the rectangular section of the cone portion 12*a*. An anode button 16 is formed in the funnel 12 for the supply of a high voltage inside the funnel 12, and an inner graphite layer 18 is deposited over an entire inner surface of the funnel 12 to enable the high voltage supplied through the anode button 16 to be transmitted to the electron gun assembly 10.

Figure 3:
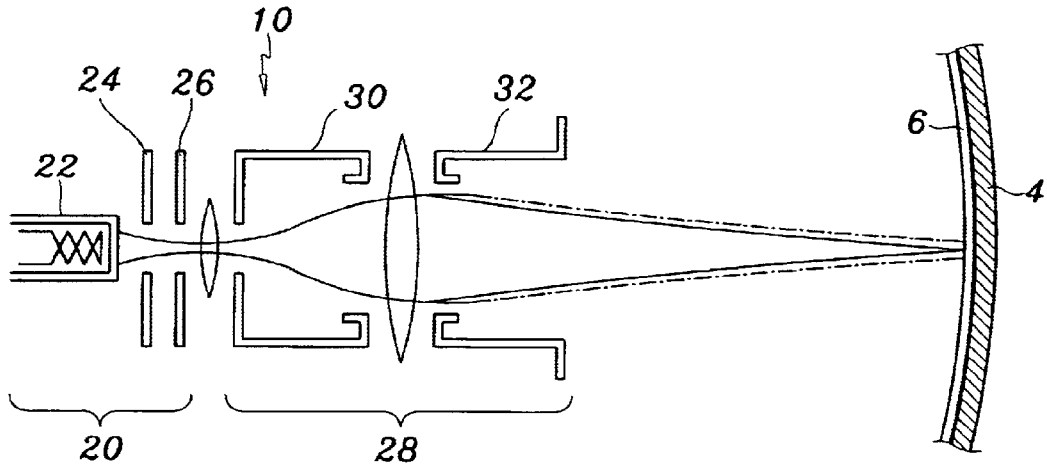
FIG. 3 is a schematic view of an electron gun assembly shown in FIG. 1, and a path of electron beams of the electron gun toward a panel.

As shown in FIG. 3, the electron gun assembly 10 for generating electron beams includes a triode 20 and a main focusing lens portion 28. The triode 20 is formed with a cathode 22 emitting heat electrons, and first and second grid electrodes 24 and 26 prefocusing the electrons. The main focusing lens portion 28 comprises a focusing electrode 30 and an accelerating electrode 32 for respectively focusing and accelerating the electron beams onto the phosphor screen 6.

In the above electron gun assembly 10, the cathode 22, first and second grid electrodes 24 and 26, and focusing electrode 30 are respectively supplied required voltages through stem pins 34 (see FIG. 2) connected to an external circuit (not shown).

The main focusing lens portion 28 forms a main focusing lens by a difference in potential between voltages supplied to the focusing electrode 30 and the accelerating electrode 32. The focusing electrode 30 Is supplied about 7–8 kV through the stem pins 34, while the accelerating electrode 32 is supplied a high voltage of about 25 kV through a bulb spacer 36 (see FIG. 2) which extends from the accelerating electrode 32 and contacts the inner graphite layer 18.

The inner graphite layer 18 transmits the high voltage to the accelerating electrode 32 of the electron gun assembly 10, and at the same time applies the high voltage to the panel 4 and a shadow mask 38, the shadow mask 38 dividing three electron beams to each phosphor layer. As a result, the electron beams of minus potential are accelerated onto the phosphor screen 6. In addition, the inner graphite layer 18 acts as a capacitor together with an outer graphite layer (not shown), which is deposited on an outer surface of the funnel 12, so as to prevent a ripple effect generated when alternating current is converted into direct current.

To perform such operations, it is necessary that the inner graphite layer 18 has a constant resistance so that it can uniformly transmit the high voltage. This constant resistance is realized by the inner graphite layer 18 being deposited at a uniform thickness over the entire inner surface of the funnel 12, including the cone portion 12*a*.

However, when a conductive graphite powder is applied and dried on the inner surface of the funnel 12, the resulting inner graphie layer 18 has a different thickness in comer portions of the cone portion 12*a* (i.e., in regions where the projection of diagonal lines of the phosphor screen 6 intersect the inner surface of the cone portion 12*a*) than or the inside surface of the four walls forming the cone portion 12*a*.

The CRT of the present invention provides an optimum thickness of the inner graphite layer 18 to all inside surface portions of the funnel .12 including the comers of the cone portion 12*a* to minimize variations in resistance.

Figure 4:
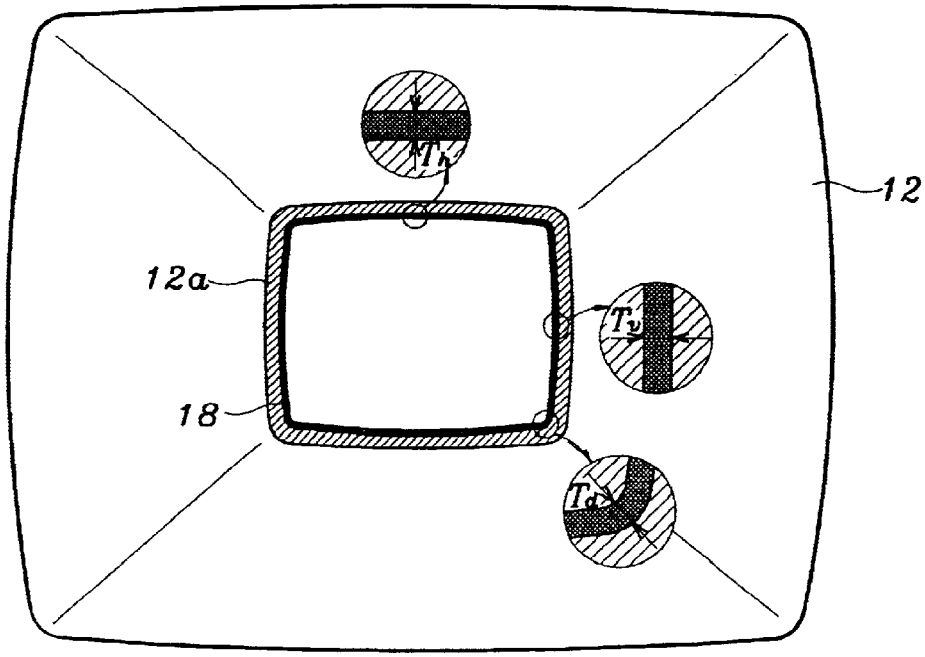
FIG. 4 is a sectional view taken along line IV—IV of FIG. 1.

FIG. 4 shows a sectional view taken along line IV—IV of FIG. 1. As shown in FIG. 4, the inner graphite layer 18 disposed on the inner surface of the cone portion 12*a* satisfies the following condition:

$$0.9 \leqq Td/Th \leqq 1.36$$

where Td is an approximate thickness of the inner graphite layer 18 disposed on the each inside comers of the cone portion 12*a*, and Th is an approximate thickness of the inner graphite layer 18 disposed on horizontal (in the drawing) inside walls of the cone portion 12*a*.

Further, the inner graphite layer 18 satisfies the following condition:

$$0.9 \leqq Td/Tv \leqq 1.36$$

where Tv is an approximate thickness of the inner graphite layer 18 disposed on vertical (in the drawing) inside walls of the cone portion 12*a*.

The thickness Th of the horizontal inside walls and the thickness Tv of vertical inside walls are substantially the same.

Described CRT structured as in the above, since the thickness ratio Td/Th or Td/Tv is 0.9–1.36, the inner grahite layer 18 has sutitable characteristics. That is, if the thickness ratio Td/Th or Td/Tv becomes less than 0.9, the inner graphite layer 18 does not uniformly transmit the high voltage because of the thin deposition on the corners relative to the inside wall. Further, if the thickness ratio Td/Th or Td/Tv becomes more than 1.36, the inner graphite layer is thicker on the comers than on the inside walls such that the resistance of the inner graphite layer 18 increases, causing a recduction in the voltage level supplied to the panel 4 and the accelerating electrode 32.

The above conditions of the thickness ratio of the inner graphite layer are based on the results of several tests and simulations, which show the transmission efficiency of voltage is optimized when the thickness of the inner graphite layer meets the conditions.

By meeting the two thickness-related conditions with regard to the inner graphite layer, the CRT according to the present invention can uniformly transmit the high voltage, and minimize a drop in the voltage.

While the present invention has been described in detail with reference to the preferred embodiment, those skilled in the art will appreciate that various modifications and substitutions can be made thereto without departing from the spirit and scope of the present invention as set forth in the appended claims.

What is claimed is:

1. A cathode ray tube comprising:

a panel having a phosphor screen;

a cylindrical neck having an electron gun assembly disposed therein for generating a plurality of electron beams;

a funnel formed between the panel and the neck, and having a substantially rectangular cone portion contiguous to the neck, the substantially rectangular cone portion having rounded inside corners tangentially joining adjacent cone walls of the rectangular cone portion, an anode button on the funnel to supply a voltage in the funnel; and an inner graphite layer disposed on an inner surface of the funnel to form a path for transmission of the voltage, wherein the inner graphite layer satisfies the following condition:

$$Td/Th \text{ is within the ranges of either } 0.9 \leqq Td/Th < 1 \text{ or } 1 < Td/Th \leqq 1.36$$

where Td is an approximate thickness of the inner graphite layer along each rounded inside corner tangentially joining adjacent cone walls of the rectangular cone portion, and Th is an approximate thickness of the inner graphite layer disposed on inside horizontal walls of the cone portion.

2. A cathode ray tube comprising:

a panel having a phosphor screen;

a cylindrical neck having an electron gun assembly disposed therein for generating a plurality of electron beams;

a funnel formed between the panel and the neck, and having a substantially rectangular cone portion contiguous to the neck, the substantially rectangular cone portion having rounded inside corners tangentially joining adjacent cone walls of the rectangular cone portion;

an anode button on the funnel to supply a voltage ii the funnel; and an inner graphite layer disposed on an inner surface of the funnel to form a path for transmission of the voltage, wherein the inner graphite layer satisfies the following condition:

$$Td/Tv \text{ is within the ranges of either } 0.9 \leqq Td/Tv < 1 \text{ or } 1 < Td/Tv \leqq 1.36$$

where Td is an approximate thickness of the inner graphite layer along each rounded inside corner tangentially joining adjacent cone walls of the rectangular cone portion, and Tv is an approximate thickness of the inner graphite layer disposed on inside vertical walls of the cone portion.

* * * * *